US005630501A

United States Patent [19]

Tsay

[11] Patent Number: 5,630,501

[45] Date of Patent: May 20, 1997

[54] COMPUTER KEY

[75] Inventor: Laurance Tsay, Taipei Hsien, Taiwan

[73] Assignee: Shin Jiuh Corp., Hsin-Tien, Taiwan

[21] Appl. No.: 667,804

[22] Filed: Jun. 20, 1996

[30] Foreign Application Priority Data

Apr. 12, 1996 [TW] Taiwan ..... 85205202

[51] Int. Cl.[6] ..... H01H 13/70

[52] U.S. Cl. ..... 200/344; 200/341

[58] Field of Search ..... 200/344, 341, 200/345, 520, 512

[56] References Cited

U.S. PATENT DOCUMENTS 4,902,862 2/1990 Oelsch et al. ..... 200/344

5,278,374 1/1994 Takagi et al. ..... 200/344

*Primary Examiner*—David J. Walczak

*Attorney, Agent, or Firm*—Finnegan, Henderson, Farabow, Garrett & Dunner

[57] ABSTRACT

A computer key includes a membrane circuit, an upper base member, an upright elastomeric biasing member, generally rectangular first and second linking frames, and a pushbutton. Each of the first and second linking frames includes a transverse axle, a pair of longitudinal linking arms extending from two ends of the axle, a pair of transverse projections disposed respectively at intermediate portions of the linking arms, and a pair of recesses respectively adjacent to the projections. Each of the recesses is formed with an upwardly facing bearing surface. The projections and the recesses are positioned and dimensioned such that in order to join the frames pivotally, one of the linking frames can be press fitted on the other so as to shorten the assembly time during mass production of the computer key.

3 Claims, 8 Drawing Sheets

COMPUTER KEY

BACKGROUND OF THE INVENTION

1. Field of the Invention

The invention relates to a computer key, more particularly to a computer key which is easier to assemble as compared to that of a conventional computer key.

2. Description of the Related Art

Referring to FIGS. 1 and 2, a conventional computer key 1 is shown to include a base board consisting of a lower base plate (not shown) and a membrane circuit 50A, an upper base member 300, an upright elastomeric biasing member 400, a frame unit 20 consisting of first and second linking frames 21, 22, and a push button 10. The membrane circuit 50A is disposed above the lower base plate (not shown) and includes an upper circuit layer 500 with a first contact area 500*a*, a lower circuit layer 502 with a second contact area 502*a*, and a spacer layer 501 interposed between the upper circuit layer 500 and the lower circuit layer 502 so as to separate the first and second contact areas 500*a*, 502*a*. The upper base member 300 is disposed above and cooperates with the lower base plate to sandwich the membrane circuit 50A therebetween and includes a contact opening 300*a* to expose the first contact area 500*a* of the upper circuit layer 500, a first hingeably retaining groove 300*c*, and a first slidably retaining guideway 300*b*. The push button 10 has a second hingeably retaining groove 10*a* and a second slidably retaining guideway 10*b* disposed in an underside thereof. The biasing member 400 is placed in the frame unit 20, which in turn is disposed between the push button 10 and the upper base member 300 such that transverse axles 214 of the first linking frame 21 and hooking fingers 223 of the second linking frame 22 engage operably the groove and guideway 300*c*, 300*b* of the upper base member 300 and the groove and guideway 10*a*, 10*b* of the push button 10. Accordingly, the push button 10 can be actuated against biasing action of the biasing member 400 to depress the upper circuit layer 500 to achieve an electric contact between the first and second contact areas 500*a* and 502*a*.

Note that each of the longitudinal first linking arms 211 in the first linking frame 21 is formed with a pivot hole 213, while each of the longitudinal second linking arms 221 in the second linking frame 22 is formed with a pivot 224. Prior to forming the conventional computer key, the pivots 224 of the second linking frame 22 cannot be press fitted into the pivot holes 213 in the first linking frame 21 in order to join the first and second linking frames 21, 22 pivotally. Therefore, other additional tools must be employed in order to accomplish the pivotal attachment of the frames 21, 22. This consequently results in increased manufacturing cost and in a longer assembly time.

SUMMARY OF THE INVENTION

The object of this invention is to provide a computer key which includes two linking frames which can be press fitted so as to form a pivotal connection therebetween.

Accordingly, the preferred embodiment of a computer key of this invention includes a base board consisting of a lower base plate and a membrane circuit, an upper base member, an upright elastomeric biasing member, first and second linking frames, and a pushbutton. The structures of the lower base plate, the membrane circuit, the upper base member, the biasing member, and the push button are generally similar to that of the aforesaid prior art except that each of the first and second linking frames includes a pair of longitudinal linking arms which have a pair of projections disposed respectively in intermediate portions thereof, and a pair of recesses disposed respectively adjacent to the projections. Each of the recesses is formed with an upwardly facing bearing surface. The projections and recesses of the linking arms in the linking frames are positioned and dimensioned in such a manner that, in order to pivotally joining the linking frames together, one of the linking frames is hingeably retained in a retaining groove of the upper base member and after which the other one of the linking frames is inserted into an oppositely disposed slidably retaining guideway of the upper base member. Then intermediate portions of the other linking frame are pressed downwardly against the former linking frame, thereby journalling the projections on the bearing surfaces of the recesses respectively. Under this condition, the push button is then press fitted on the linking frames such that the latter engage a retaining groove and a retaining guideway formed in an underside of the push button.

In mass production, the above-mentioned joining actions shorten the assembly time and consequently reduce the manufacture cost.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENTS

Figure 1:
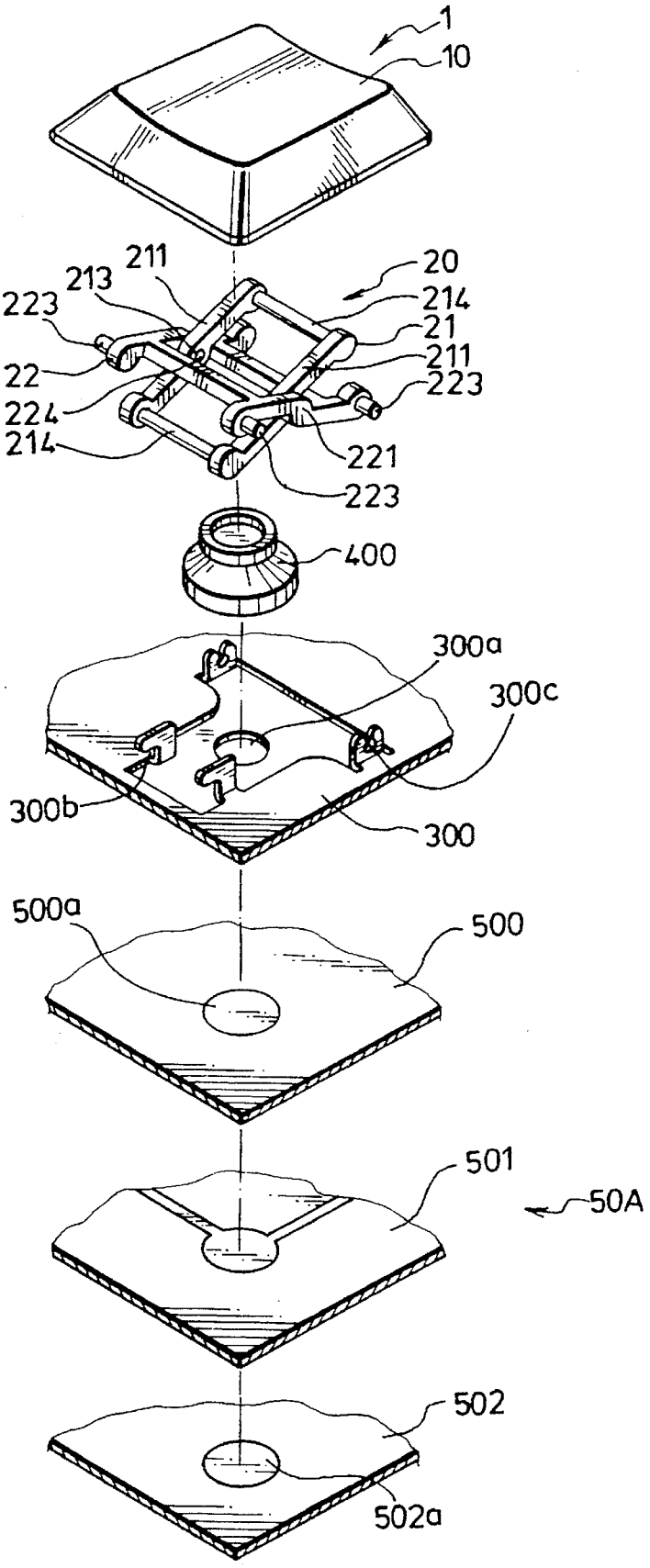
FIG.1 (PRIOR ART)
FIGS. 1 and 2 respectively show exploded and sectional views of a conventional computer key.
Figure 2:
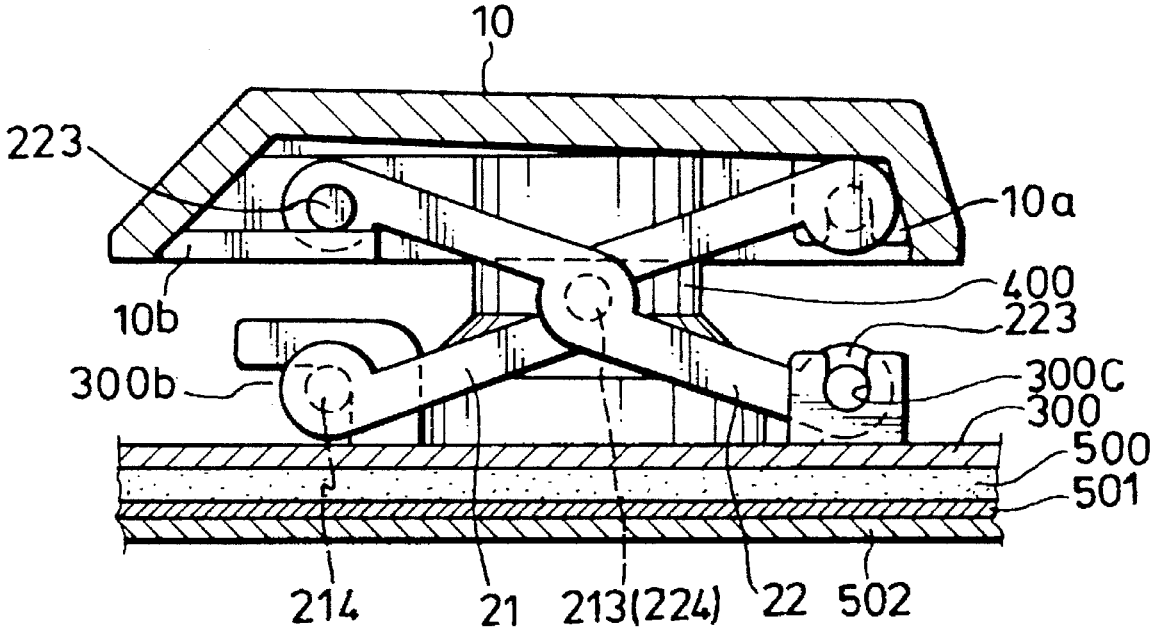
FIG. 2 (PRIOR ART)
Figure 3:
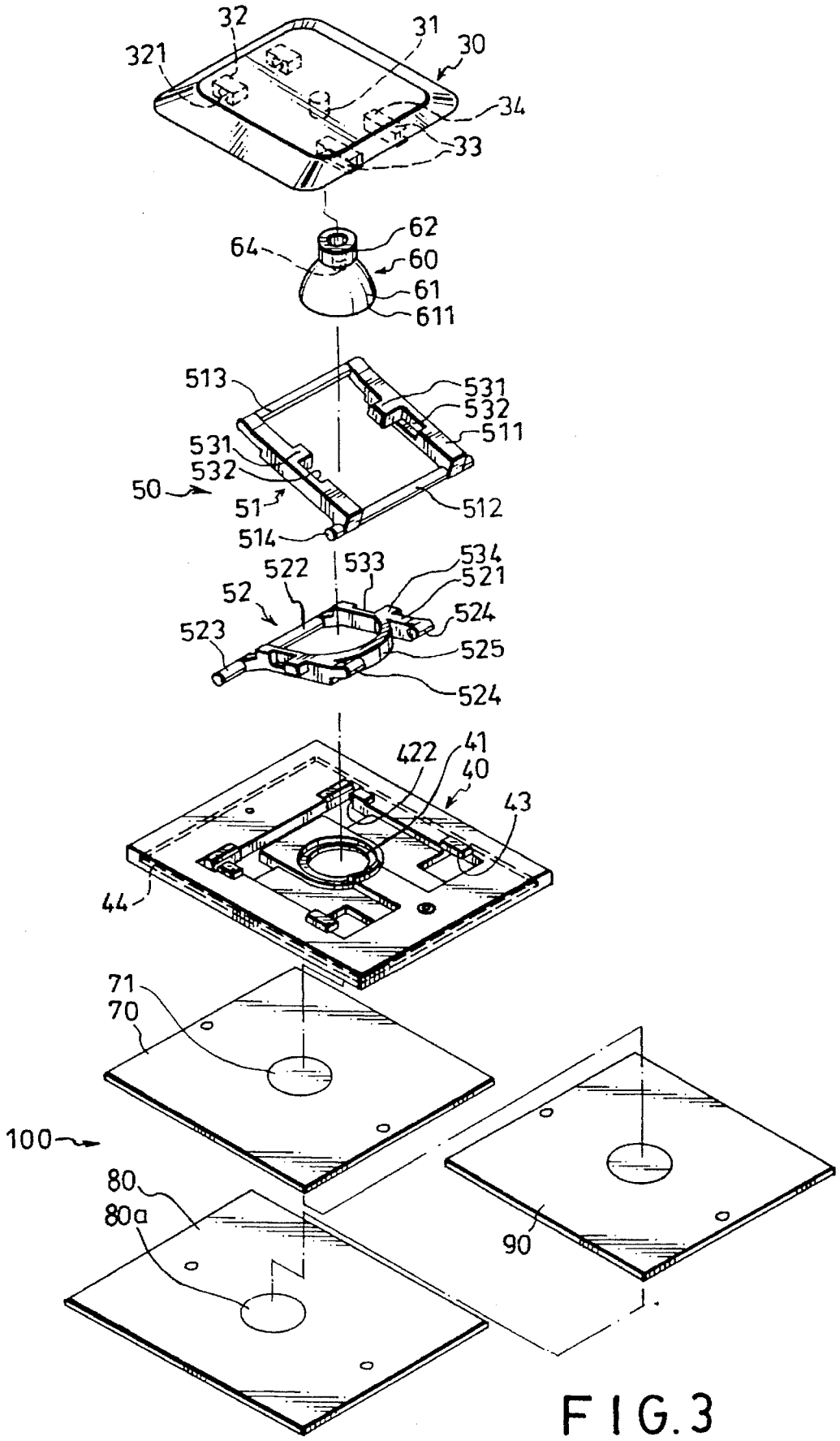
FIG. 3 is an exploded view of a computer key of this invention.
Figure 4:
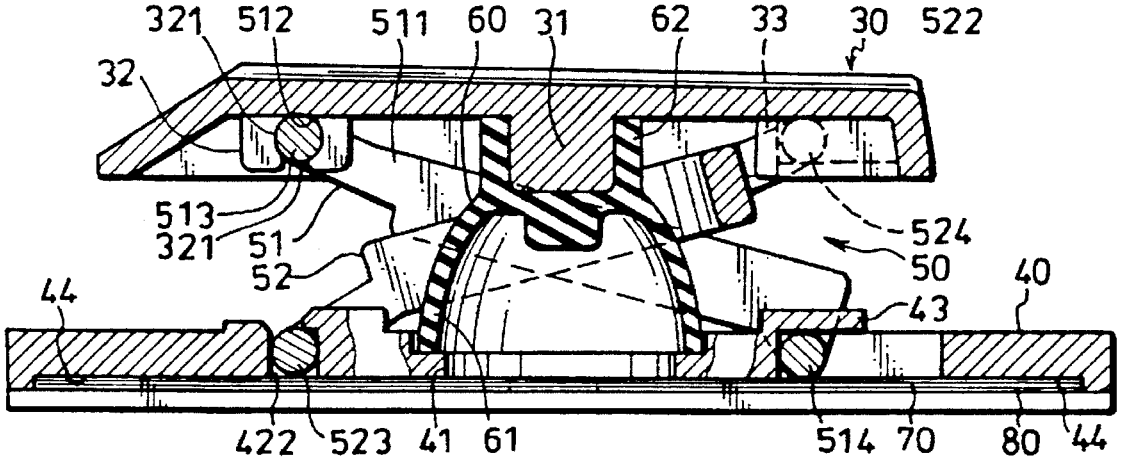
FIG. 4 is a sectional view of the computer key of this invention.

Referring to FIGS. 3 and 4, the preferred embodiment of a computer key according to this invention is shown to include a base board consisting of a lower base plate (not shown) and a membrane circuit 100, an upper base member 40, an upright elastomeric biasing member 60, a frame unit 50 consisting of generally rectangular first and second linking frames 52, 51, and a push button 30.

As illustrated, a membrane circuit 100 is disposed above the lower base plate (not shown) and includes an upper circuit layer 70 with a first contact area 71, a lower circuit layer 80 with a second contact area 80*a*, and a spacer layer 90 interposed between the upper circuit layer 70 and the lower circuit layer 80 so as to separate the first contact area 71 from the second contact area 80*a*. The membrane circuit 100 is sandwiched between the lower base plate (not shown) and the upper base member 40.

The upper base member 40 is a rectangular plate and has a recess 44 formed in a lower surface for accommodation of the membrane circuit 100 therein, a contact opening 41 to expose the first contact area 71 of the upper circuit layer 70, a first retaining groove 422, and a first retaining guideway 43 disposed on an opposite side of the contact opening 41 relative to the retaining groove 422.

The biasing member 60 has a tubular spacing lower portion 61 placed on the upper base member 40 such that the periphery 611 thereof fits in the contact opening 41, and an upper depressing portion 62 formed with a downwardly extending press rod 64.

The push button 30 includes a downwardly extending positioning stub 31, and two rows of mounting blocks 32, 34 located on two sides of the stub 31 respectively. The mounting blocks 32, 34 define a second retaining groove 321 and a second retaining guideway 33 in an underside of the push button 30.

The first linking frame 52 is generally made of plastic and includes a first transverse axle 522 and a pair of longitudinal first linking arms 521 respectively and radially extending from two ends of the first transverse axle 522. The first linking arms 521 includes a pair of first hooking fingers 524 formed at distal ends thereof and transverse to the first linking arms 521, a pair of first projections 534 respectively disposed at intermediate portions of the first linking arms 521, a pair of first recesses 533 respectively adjacent to the first projections 534, and a first bracing member 525 disposed transversely between the first linking arms 521 to provide rigidity and firmness to the first hooking fingers 524.

The second linking frame 51 is generally made of plastic and includes a second transverse axle 513, a pair of longitudinal second linking arms 511 respectively and radially extending from two ends of the second transverse axle 513, a pair of second hooking fingers 514 respectively disposed at and transverse to distal ends of the pair of second linking arms 511, a pair of second projections 531 disposed respectively in intermediate portions of the second linking arms 511, a pair of second recesses 532 disposed respectively adjacent to the second projections 531, and a second bracing member 512 disposed transversely between the distal ends of the second linking arms 511 to give firmness to the second hooking fingers 514.

Figure 5:
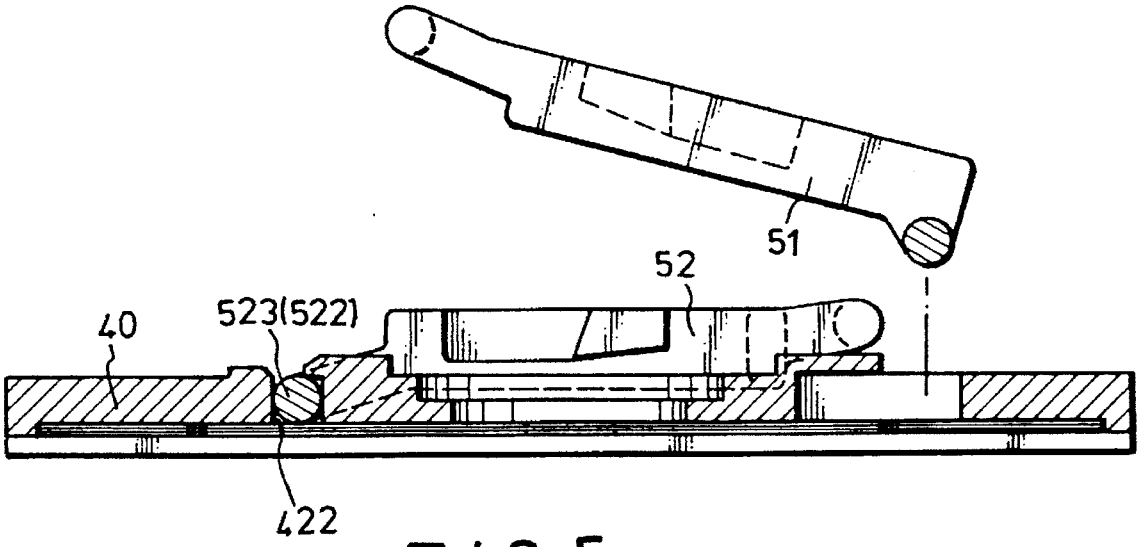
FIG. 5 illustrates how a first linking frame is mounted on an upper base member employed in the computer key of this invention.
Figure 6:
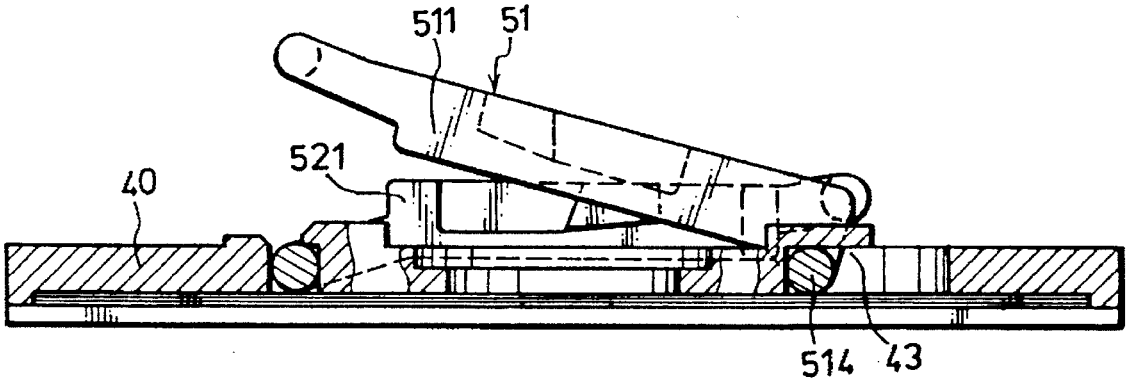
FIG. 6 illustrates how a second linking frame is mounted on an upper base member employed in the computer key of this invention.

Note that in this embodiment, each of the recesses 533, 532 in the first and second linking frames 52, 51 has an upwardly facing bearing surface. The projections 534, 531 and the recesses 533, 532 are positioned and dimensioned so as to facilitate connection between the first and second linking frames 52, 51 in the following manner:

Referring to FIG. 5, two engaging tongues 523 of the first axle 522 are hingeably retained in the first retaining groove 422 of the base member 40 such that the first linking frame 52 lies flat on the base member 40. As shown in FIG. 6, after inserting the second hooking fingers 514 of the second linking frame 51 into the first retaining guideway 43 of the base member 40, the intermediate portions of the second linking arms 511 can be disposed on the first linking arms 521 in such a manner that the former forms an acute angle relative to the latter.

Figure 7:
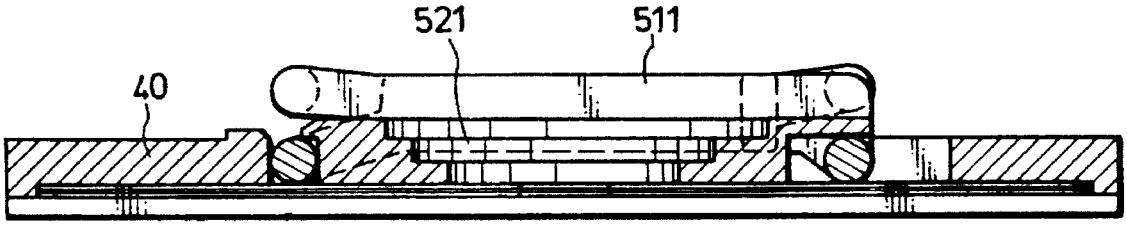
FIG. 7 illustrates how the first and second linking frames are mounted on the upper base member employed in the computer key of this invention.

As shown in FIG. 7, the intermediate portions of the second linking arms 511 are pressed downwardly against the first linking arms 521, wherein the projections (not visible) engage the recesses (not visible), thereby journalling the projections 534, 531 (see FIG. 3) on the bearing surfaces respectively so as to provide the hooking fingers with resistance to downward movement of the push button while the second linking arms 511 flank the first linking arms 521.

Figure 8:
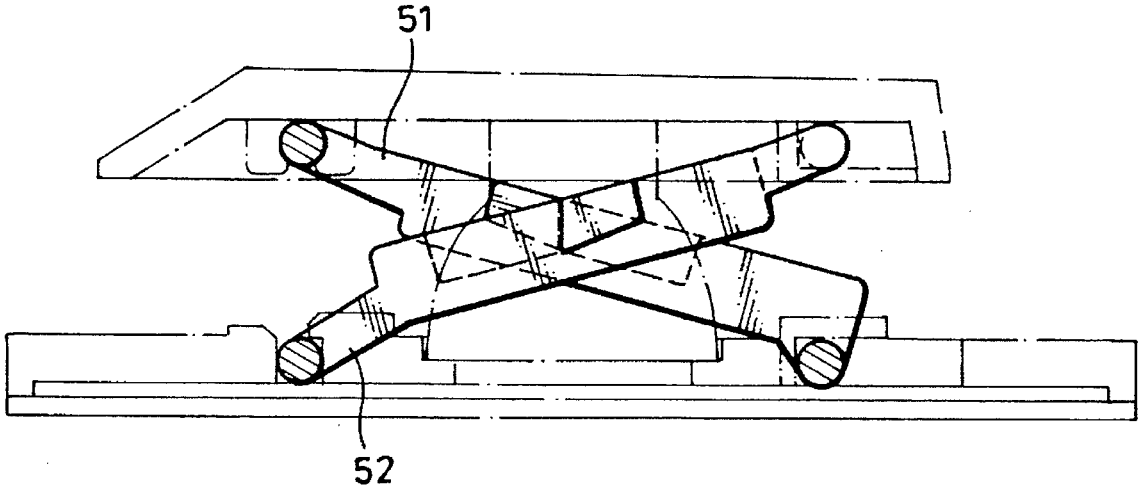
FIG. 8 is a schematic view of the first and second linking frames prior to mounting of a push button thereon so as to form the computer key of this invention.

Referring to FIGS. 4 and 8, the positioning stub 31 of the push button 30 is inserted into the upper depressing portion 62 of the biasing member 60 so as to place the second retaining groove 321 and the second retaining guideway 33 of the push button 30 in diagonal positions relative to the first retaining guideway 43 and the first retaining groove 422 of the upper base member 40. Under this condition, depression of the push button 30 against biasing action of the biasing member 60 completes engagement of the second axle 513 of the second linking frame 51 in the second retaining groove 321 of the push button 30 while the first hooking fingers 524 of the first linking frame 51 is retained slidably in the second guideway 33 of the push button 30.

In mass production, positioning of the first and second frames 52, 51 on the base member 40, the joining of the first and second frames 52, 51 relative to each other, and the fixing of the push button 30 on the frames 52, 51 can be achieved in a fully automated manner with the use of a machine so as to shorten the assembly time and correspondingly reduce the manufacturing cost of the computer key.

Figure 9:
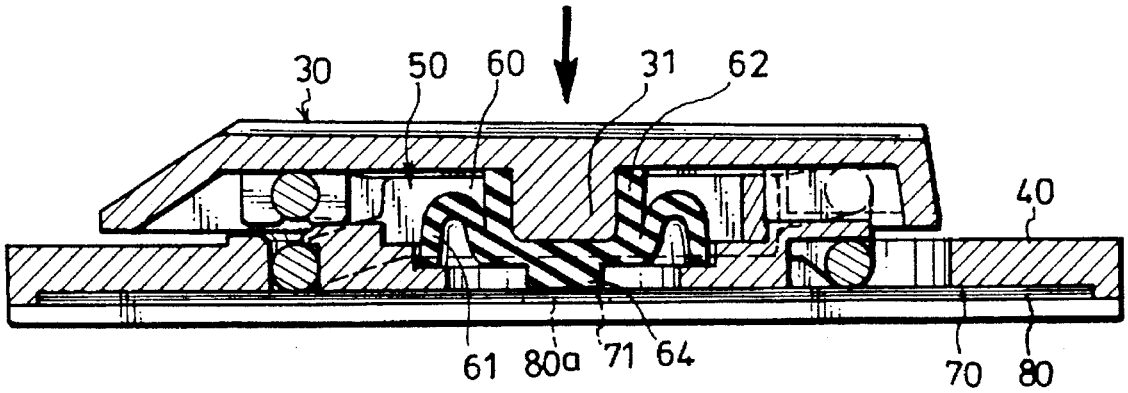
FIG. 9 is a sectional view of the computer key of this invention when depressed.
Figure 10:
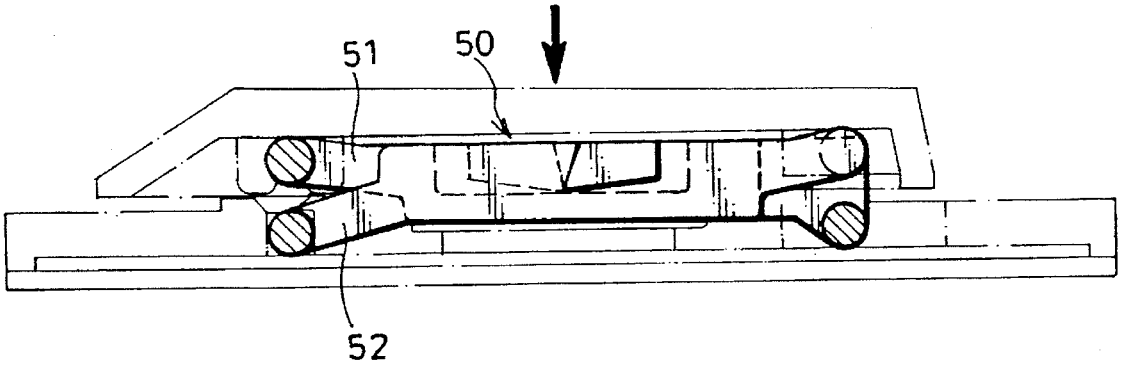
FIG. 10 is a schematic view of the computer key of this invention at the depressed position.

Referring to FIGS. 9 and 10, in use, when the push button 30 is depressed downward, the press rod 64 in the upper depressing portion 62 of the biasing member 60 extends into the tubular lower portion 61 so as to achieve an electric contact between the first and second contact areas 71, 80*a* of the upper and lower circuit layers 70, 80. Note that the positions of the projections 534, 531 (see FIG. 3) in the recesses 533, 532 (see FIG. 3), and the relative position of the biasing member 60 between the push button 30 and the upper base member 40 are retained such that a force applied on any position on the push button 30 will enable proper contact between first and second contact areas 71, 80*a*.

Figure 11:
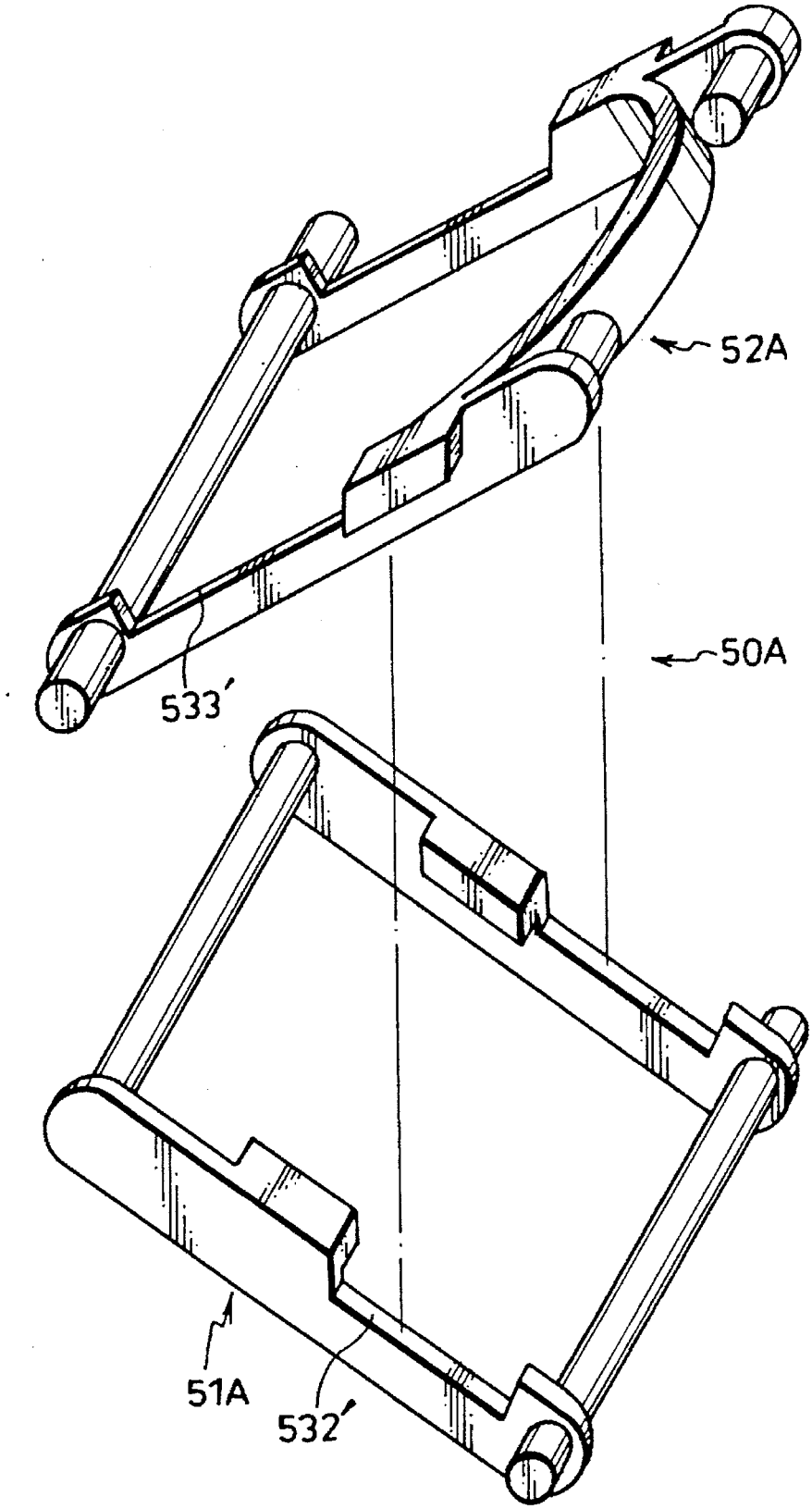
FIG. 11 is a modified pair of linking frames employed in the computer key of this invention.

Referring to FIG. 11, a modified frame unit 50A of this invention is shown to include first and second linking frames 52A, 51A, wherein each of the frames 52A, 51A has a pair of elongated recesses 533', 532' formed in longitudinal lengths of the linking arms and projections adjacent to the recesses 533', 532' such that the frames 52A, 51A can be press fitted in order to join pivotally each other. The functions and features are the same as those of the previous embodiment.

With this invention thus explained, it is obvious to those skilled in the art that various modifications and variations can be made without departing from the scope and spirit thereof. It is therefore intended the invention be limited only as in the appended claims.

I claim:

1. A computer key comprising:

a base board including a lower base plate, a membrane circuit disposed above said lower base plate, said membrane circuit including an upper circuit layer with a first contact area, a lower circuit layer with a second contact area, and a spacer interposed between said upper circuit layer and said lower circuit layer so as to space first contact area with said second contact area, and an upper base member disposed above said membrane circuit to sandwich said membrane circuit between said lower base plate and said upper base member, said upper base member having a contact opening to expose said first contact area, a first hingeably retaining groove, and a first slidably retaining guideway disposed on an opposite side of said contact opening relative to said hingeably retaining groove;

an upright elastomeric biasing member having an upper depressing portion, and a spacing lower portion to space said upper depressing portion from said first contact area, said upper depressing portion being movable against biasing action of said upright elastomeric biasing member to depress said first contact area so as to make electric contact between said first and said second contact areas;

a push button disposed to actuate said depressing portion to move said depressing portion toward said first contact area, said push button having a second hingeably retaining groove and a second slidably retaining guideway disposed in an underside of said pushbutton and in diagonal positions relative to said first slidably retaining guideway and said first hingeably retaining groove respectively;

a first plastic linking frame including a first transverse axle capable of being press fitted to and hingeably retained in said first hingeably retaining groove; and a pair of longitudinal first linking arms respectively and radially extending from two ends of said first transverse axle, said first longitudinal linking arms having:

a pair of first hooking fingers respectively disposed at and transverse to distal ends of said pair of first linking arms, said hooking fingers being capable of being press fitted to and slidably retained in said second slidably retaining guideway; a pair of first projections disposed respectively in intermediate portions of said first linking arms; and a pair of first recesses disposed respectively adjacent to said first projections, each of said first recesses having a first bearing surface that faces upwards; and a second plastic linking frame including a second transverse axle capable of being press fitted to and hingeably retained in said second hingeably retaining groove; and a pair of longitudinal second linking arms respectively and radially extending from two ends of said second traverse axle, and flanking said pair of first linking arms respectively when said upper depressing portion is in a depressed position, said second longitudinal linking arms having:

a pair of second hooking fingers respectively disposed at and transverse to distal ends of said pair of second linking arms, said second hooking fingers being capable of being of press fitted to and slidably retained in said first slidably retaining guideway; and a pair of second projections disposed respectively in intermediate portions of said second linking arms, and matching said pair of first recesses respectively; a pair of second recesses disposed respectively adjacent to said second projections, and matching said pair of first projections respectively, each of said second recesses having a second bearing surface that faces upwards, said first and second projections and said first and second recesses being positioned and dimensioned such that when said first transverse axle is hingeably retained in said first hingeably retaining groove, insertion of said second pair of hooking fingers into said first slidably retaining guideway will enable said second projections and recesses to press fit into said first recesses and projections through downwardly pressing of the intermediate portions of said second linking arms against the intermediate portions of said first linking arms, thereby journalling said projections on said bearing surfaces respectively during the depressing of said push button so as to provide said hooking fingers with resistance to downward movement of said pushbutton.

2. A computer key according to claim 1, wherein said first plastic linking frame includes a bracing member disposed transversely between said distal ends of said first longitudinal linking arms to provide firmness to said first hooking fingers.

3. A computer key according to claim 1, wherein said second plastic linking frame includes a bracing member disposed transversely between said distal ends of said second longitudinal linking arms to provide firmness to said second hooking fingers.

* * * * *